US005428845A

United States Patent [19]

Deagan

[11] Patent Number: 5,428,845

[45] Date of Patent: Jul. 4, 1995

[54] HELMET REMOVAL DEVICE AND METHOD

[75] Inventor: John C. Deagan, Long Grove, Ill.

[73] Assignee: Safesport, Inc., Northbrook, Ill.

[21] Appl. No.: 221,867

[22] Filed: Mar. 31, 1994

[51] Int. Cl.[6] ..... A42B 3/04

[52] U.S. Cl. ..... 2/413; 2/410; 2/422; 2/425

[58] Field of Search ..... 2/410, 411, 413, 424, 2/425, 421, 422, 417, 419, 2, 181, 181.4, 182.1, 182.2, 183

[56] References Cited

U.S. PATENT DOCUMENTS

| | | | |
|---|---|---|---|
| 1,833,708 | 11/1931 | Ford . | |
| 2,679,046 | 5/1954 | Dye . | |
| 2,802,212 | 8/1957 | Finken . | |
| 3,397,688 | 8/1968 | Gottfried . | |
| 3,668,704 | 6/1972 | Conroy et al. | 2/413 |
| 3,761,959 | 10/1973 | Dunning . | |
| 3,866,243 | 2/1975 | Morgan | 2/413 |
| 4,035,846 | 7/1977 | Jencks . | |
| 4,566,137 | 1/1986 | Gooding | 2/413 |
| 4,724,549 | 2/1988 | Herder et al. . | |
| 5,014,365 | 5/1991 | Schulz . | |
| 5,014,366 | 5/1991 | Discipio, Sr. | 2/410 |
| 5,044,019 | 9/1991 | Schewchenko et al. . | |
| 5,083,320 | 1/1992 | Halstead . | |
| 5,129,107 | 7/1992 | Lorenzo . | |
| 5,175,889 | 1/1993 | Infusino . | |
| 5,263,203 | 11/1993 | Kraemer et al. | 2/413 |

FOREIGN PATENT DOCUMENTS

| | | | |
|---|---|---|---|
| 4194005 | 7/1992 | Japan | 2/410 |
| 9004932 | 5/1990 | WIPO | 2/410 |

*Primary Examiner*—Clifford D. Crowder
*Assistant Examiner*—Michael A. Neas
*Attorney, Agent, or Firm*—Welsh & Katz, Ltd.

[57] ABSTRACT

A helmet removal device for removing a helmet from a head of a wearer without applying tensile forces on the neck of the wearer. The removal device includes a bladder disposed between the helmet and the top of the head with the bladder so constructed and arranged that upon inflation from a collapsed configuration to an expanded configuration, the bladder at least partially displaces the head from within the helmet. The removal device may also include an inserting tool for inserting the bladder between the helmet and head while the helmet is being worn.

16 Claims, 3 Drawing Sheets

HELMET REMOVAL DEVICE AND METHOD

FIELD OF THE INVENTION

The present invention relates generally to helmets and more particularly to an inflatable device for removing a protective helmet from the head of a wearer without placing injurious tensile or other forces on the neck of the wearer who may have sustained a spinal or neck injury, or some other sensitive injury.

Helmets are frequently used in activities or situations to protect the head of a wearer which may be exposed to injurious blows or forces. Typically these protective helmets include pads or padding so that the helmet fits snugly about the head. Because of the snug fit of the helmet about the head an appreciable amount of force must be typically exerted on the helmet, to lift the helmet off of the head. This lifting force is typically applied by grasping the lower edge of the helmet and pushing or pulling the helmet up. An opposing tensile force is then transmitted to the neck of the wearer.

The wearer of such a helmet may be involved in an accident which causes the wearer to sustain a spinal or neck injury. After such an accident, to begin treatment of the wearer or in some instances to move the wearer, it is desirable if not absolutely necessary, to remove the helmet. However the method of pulling the helmet off the head described above and the resulting tensile forces transmitted to the neck and spinal cord may further injure the wearer.

To remove the helmet without applying the tensile forces to the neck, the helmet is frequently cut off of the wearer. Such a method of removal is unduly time consuming in a distress situation when speed is critical, and of course renders the helmet unusable. In addition, such cutting tools for performing the method are typically not available when the need arises. Thus, frequently the helmet wearer must be transported to another location for helmet removal, adding further to the distress.

It is therefore an object of the present invention to provide an improved device and method for removing a helmet from about the head of a wearer.

A further object of the present invention is to provide an improved method and device for removing a helmet from about the head of a wearer while minimizing if not eliminating the potential of transmitting forces to the neck of the wearer.

Yet another object of the present invention is to provide an improved method and device for removing a helmet from about the head of a wearer with the device and method adapted for use with a helmet after the helmet is placed about the head of the wearer.

A still further object of the present invention is to provide an improved device for removing a helmet from about the head of a wearer without damaging the helmet.

It is also desirable that any method and device for removing a helmet from about the head of a wearer be adapted so that the method and device may be used with existing configurations of helmets, and also, that the method and device be adapted for use after the wearer places the helmet about the head.

SUMMARY OF THE INVENTION

Accordingly, the present invention provides a helmet removal device and method for at least partially removing the head of a wearer from within a helmet so that it can be lifted off without applying force to the wearer's neck. The device includes a bladder disposed between the head and helmet, with the bladder so constructed and arranged that inflation of the bladder from a collapsed configuration to an expanded configuration at least partially displaces the head from within the helmet. The removal device also includes an arrangement for inflating the bladder by introducing a fluid, preferably a gas, into an internal chamber defined by the bladder.

More specifically, the present removal device includes a bladder which may be folded into a collapsed configuration and attached within the interior of a helmet at a location generally corresponding to the top of the head of a wearer. A tube has one end in fluid communication with an internal chamber defined by the bladder and the other end accessible to a user. A source of pressurized air is removably connected to the accessible end for selectively inflating the bladder. The inflating of the bladder increases the volume of the bladder chamber and therefore the size of the bladder causes the bladder to unfold and expand into an inflated configuration. The increase in size of the bladder causing the bladder to exert opposing forces on the top of the head of the wearer and the adjacent portion of the helmet thereby at least partially displacing the head from within the helmet.

An alternate embodiment of the invention provides the bladder and tubing described above, and further includes an elongated tool for inserting the tube between the head of the wearer and the helmet and placing the bladder in a collapsed configuration at a location generally about the top of the head.

DESCRIPTION OF THE PREFERRED EMBODIMENT

Figure 1:
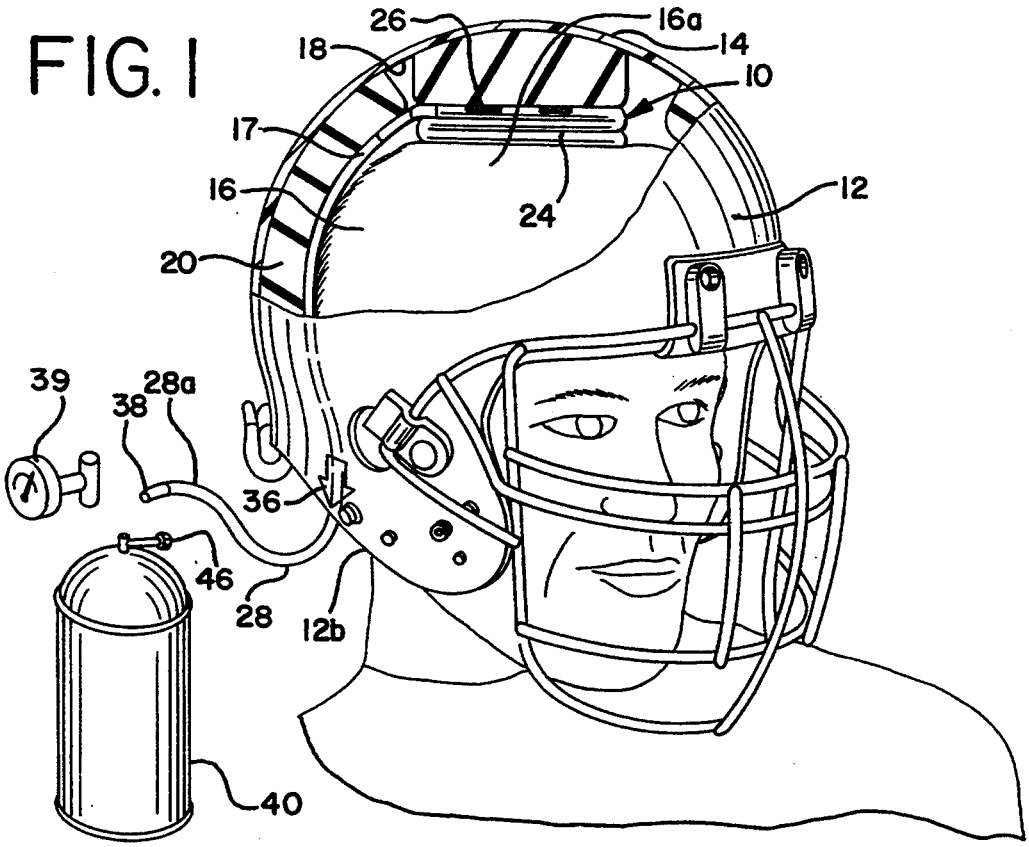
FIG. 1 is an elevational perspective view with parts broken away of a preferred embodiment of the helmet removal device of the invention disposed within a helmet which is fitted about a head.

Referring now to FIG. 1, a preferred embodiment of the helmet removal device invention is generally indicated at 10 and is shown in combination with a helmet 12. Although the illustrated helmet 12 is a football helmet, the removal device 10 finds equal application in other types of helmets, such as those used for other sports, motorcycle riders, etc. The helmet 12 includes a hard outer shell 14, and is shaped to generally fit about a head 16 of the wearer. The helmet 12 defines an internal chamber 17.

Attached to an inner surface 18 of the shell 14 is padding preferably at least one and typically a plurality of pads 20. The pads 20 are configured to form a snug fit between the helmet 12 and head 16 as is well known in the art. To accommodate heads of various configurations, the pads 20 can be constructed of resilient material, inflatable bladders or the like. Where inflatable bladders are used as pads they typically use a needle valve to the exterior surface, and are solely designed for providing comfort and protection, but they are not intended, designed or capable of helmet removal.

Figure 2:
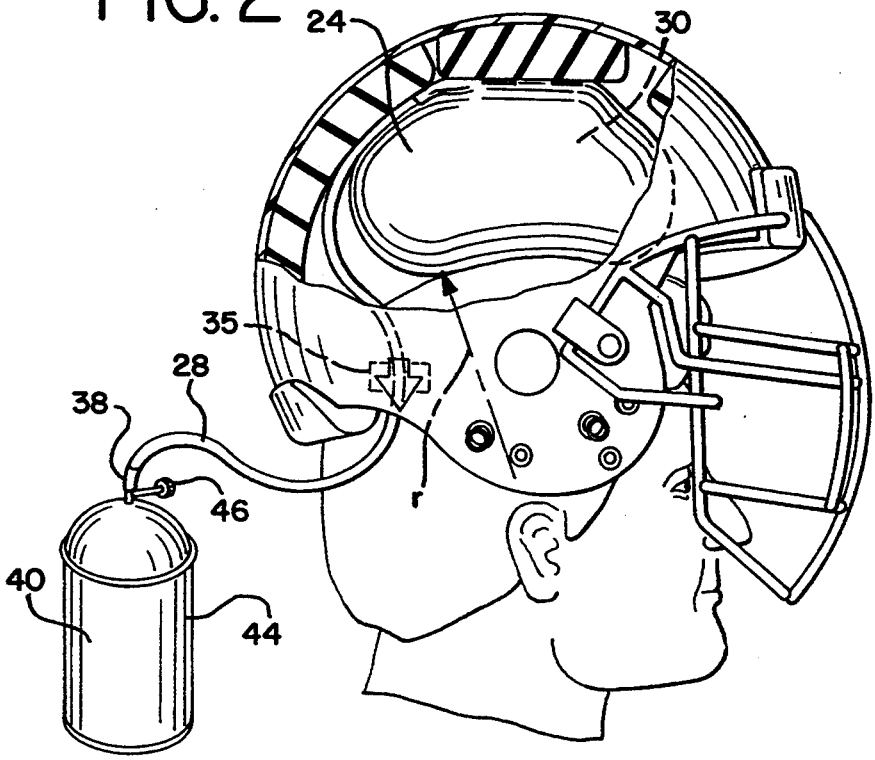
FIG. 2 is a side elevational view with parts broken away of the device of FIG. 1, with a bladder, forming a part of the device, in an expanded configuration.

The helmet removal device 10 includes a bladder 24 disposed between the helmet 12 and head 16. The bladder 24 is so constructed and arranged that the inflation and expansion of the bladder from the collapsed configuration, as illustrated in FIG. 1, to the expanded configuration, as illustrated in FIG. 2, at least partially displaces the head 16 from within the helmet 12. Preferably, the inflation of the bladder 24 displaces the head 16 from the helmet 12 to such a distance that the helmet may be completely removed from the head without exerting any potentially damaging tensile forces on the wearer's neck.

In the preferred embodiment, the bladder 24 is composed of a material which does not appreciably stretch when the bladder undergoes inflation. The bladder 24 is folded to place the bladder in the collapsed configuration, and during inflation, the bladder 24 unfolds into the expanded configuration. Also, during inflation, portions of the surface of the bladder 24 rub not only against the helmet 12 but also against other portions of the bladder. Thus, the bladder 24 should preferably be composed of a material which is durable but has a smooth, low friction surface. One particular material which has produced particularly good results is a laminate with an outer layer of polyester and an inner layer of polyethylene, such as a film manufactured by Columbus Packaging Co., of Columbus, Ga.

Bladders 24 composed of other materials have also been found to offer satisfactory results. For example, the bladder 24 may also be composed of a material which stretches during inflation. Use of a stretchable material may allow the bladder 24 to be placed in the collapsed configuration without folding. However, in using a stretchable material as well as an unstretchable material the toughness or durability of the material should be considered so that the bladder 24 does not rupture during inflation.

It is also preferred that the bladder 24 be constructed so that during inflation an appreciable amount of the gas does not leak out of the bladder which may prevent the bladder from inflating to the desired expanded configuration. Thus in addition to being sealed, the bladder should be constructed of a material which is relatively impermeable, at least for the time period during which the bladder undergoes inflation and expansion.

Referring again to FIG. 1, the bladder 24 is removably attached to the helmet 12 by adhesive tabs or tape 26. Removably attaching the bladder 24 to the helmet 12, allows the bladder to be replaced after use and also allows the device 10 to be fitted within existing helmets 12.

The bladder 24 is attached in the collapsed configuration to the helmet 12 so that the bladder is generally disposed over the top 16*a* of the head 16. Thus, during the initial stages of inflation the force exerted by the bladder 24 on the head is directed toward the top of the head so that the helmet is displaced directly away from the head without the bladder applying lateral forces on the head.

Referring to FIGS. 1 and 2, the removal device 10 also includes a tube 28 in fluid communication with the bladder 24 for supplying a fluid, preferably a gas such as air, to an internal chamber 30 defined by the bladder 24. The tube 28 is sealingly engaged to the bladder 24 by being inserted into the bladder through an opening 34 (FIG. 7) with the bladder sealed about the exterior of the tube. A lower end 28*a* of the tube 28 should be accessible preferably by constructing the tube of sufficient length so that the lower end extends outward from the helmet 12. Before use of the removal device 10, the tube may be coiled within the helmet 12 with the lower end 28*a* just within the lower edge 12*b* of the helmet. A hook and pile attachment arrangement 35 may be used to retain the tube in a coiled configuration until needed. To indicate the location of the lower end 28*a*, an indicia 36, such as an arrow, may be placed on the exterior of the helmet 12.

Figure 5:
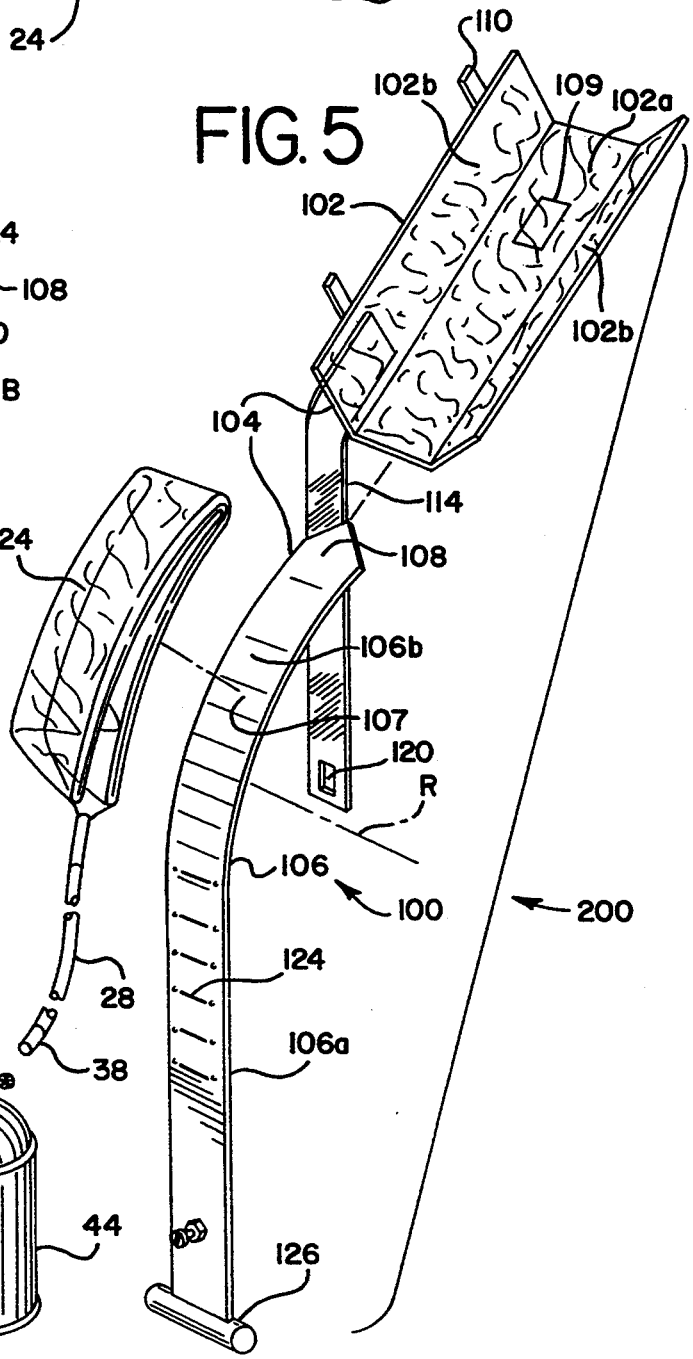
FIG. 5 is an exploded view of the device of FIG. 4.

Attached to the lower end 28*a* of the tube 28 is a connector 38 to provide a connection between the tube and a device 40 for inflating the bladder 24. The inflating device 40 may be a canister 44 of pressurized air, a pump or other similar device. Preferably the inflating device 40 includes a valve 46 or similar means for selective introduction of the pressurized air thereby controlling the inflation of the bladder 24. A gauge 39, or other pressure indicator, may be employed to assure that the canister has sufficient pressure to be operable. The gauge may be inserted in the line (FIG. 1) or in the canister or tank (FIG. 5).

The tube 28 and helmet 12 may also be configured so that the connector 38 extends through the shell 14 of the helmet 12, using a needle valve or the like, which is an arrangement commonly used for the connections between inflating devices and inflatable pads 20 within the helmet.

Figure 3:
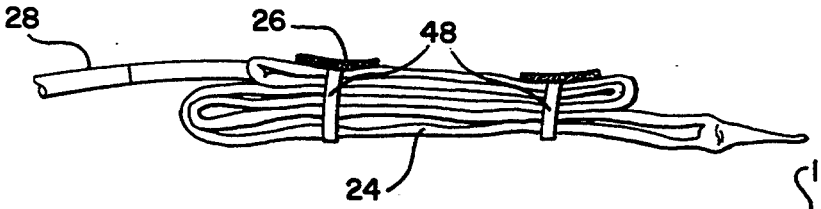
FIG. 3 is a side partial view of the device of FIG. 1.

Referring to FIG. 3, the bladder 24 is shown folded into the collapsed configuration. To retain the bladder 24 in the collapsed configuration until the bladder is inflated, tacking strips 48 extend about the sides of the bladder. Preferably the tacking strips 48 are adhesively applied about the side edges of the folded bladder 24 so that during inflation the strips' adhesive ruptures and the strips do not interfere with the inflation or damage the bladder.

Figure 7:
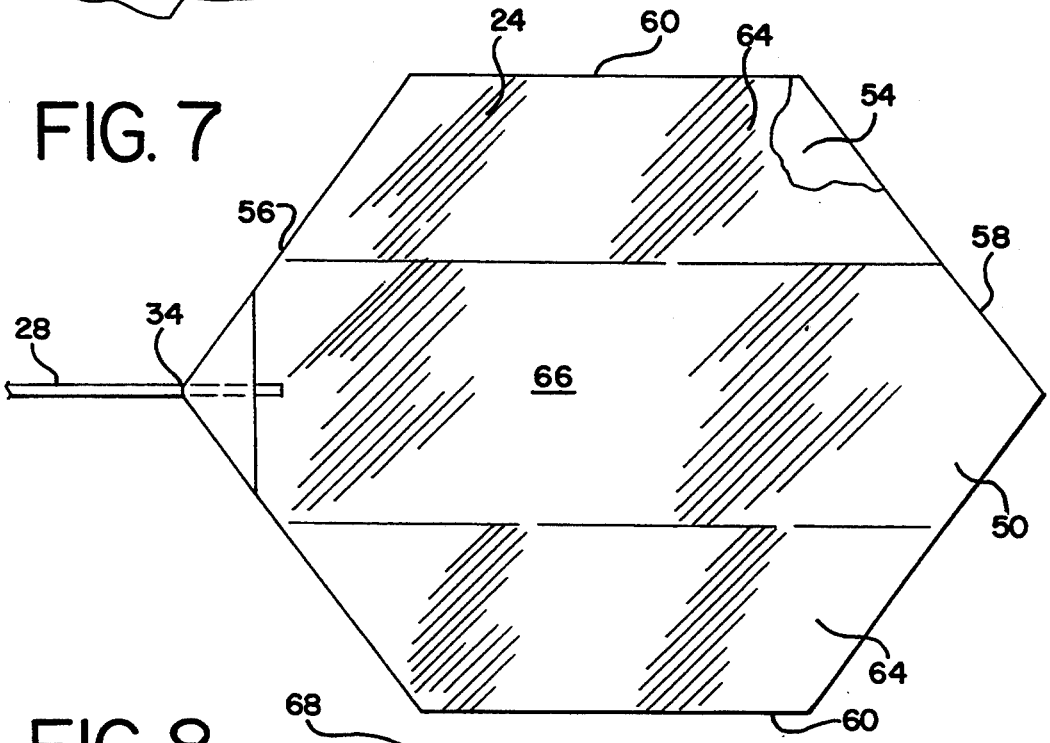
FIG. 7 is top planar view of the bladder, forming a part of the inventions of FIGS. 1 and 3, in a flattened configuration.
Figure 8:
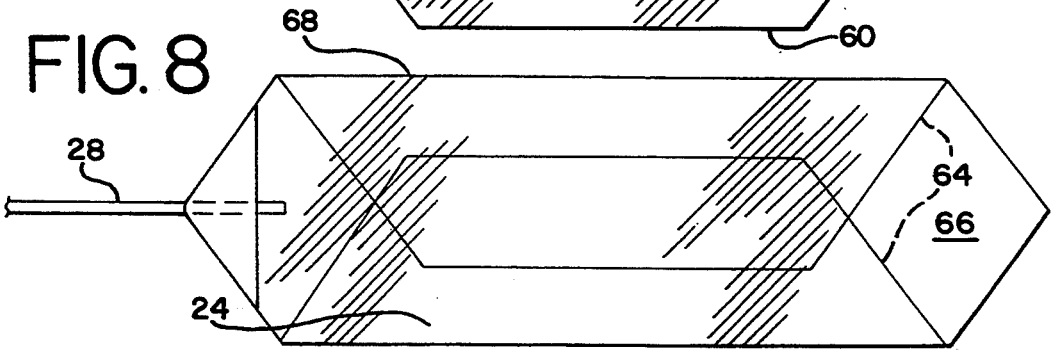
FIG. 8 is the bladder of FIG. 7 partially folded.

The bladder 24 should also be folded and attached to the helmet 12 in such a manner so that during inflation the possibility of the bladder or tube 28 becoming pinched is reduced. Referring to FIGS. 3, 7 and 8, a preferred method of folding the bladder 24 is illustrated. Referring to FIG. 7, the bladder 24 is initially laid out in a flattened configuration. In the flattened configuration, the bladder 24 forms an upper leaf 50, a corresponding lower leaf 54, angled lower edges 56 and upper edges 58 and straight side edges 60.

Referring to FIG. 8, side portions 64 of the bladder 24 are then tucked into a central portion 66 between the upper leaf 52 and lower leaf 54 to form pleats 68 with the two side portions overlapping each other. Tucking the side portions 64 within the central portion 66 insures that as the bladder 24 expands upon the initial inflation of the bladder 24, the side portions rub against the inner surface of the central portion 66 instead of against the interior of the helmet 12 (FIG. 1).

Referring back to FIG. 3 in conjunction with FIG. 1 the bladder 24 is then placed in the collapsed configuration by folding the bladder into a compressed "Z" configuration. The tacking strips 48 are then applied to retain the bladder 24 in the "Z" configuration, and the adhesive tabs 26 are attached to the bladder so that the bladder may be attached to the helmet. It is preferred that the bladder 24 is attached to the helmet 12 so that the connection between the bladder and tube 28 is adjacent the helmet. With the connection adjacent the helmet 12 and as the bladder 24 inflates, the connection remains relatively stationary relative to the helmet so that the tube 28 is not pinched. By folding the bladder 24 in a compressed "Z" configuration, as the bladder inflates the bladder is less likely to pinch itself.

Referring to FIG. 7 in conjunction with FIG. 2, also by forming the bladder 24 with angled lower edges 56 and upper edges 58, upon inflation the bladder 24 inflates into a generally spherical shape so that the shape of the bladder generally corresponds to the internal configuration of the helmet 12. In addition, the bladder 24 should be sized so that upon inflation into the expanded configuration, the bladder substantially fills the internal chamber 37 of the helmet, thereby displacing the top of the helmet 12 away from the top 16*a* of the head 16 so that the helmet may then be removed from the head without applying significant tensile forces on the neck. The displacement should be such as to lift the helmet a distance sufficient to clear the ears and portions of the wearer's head that might otherwise restrain its removal.

For example it has been found that for the typical football helmet 12, the bladder 24 may be configured with a lateral distance between the side edges of 8.25 inches, a length of 11 inches and with each of the upper edges and the lower edges of 4 inches.

It has also been found that wadding the bladder 24 up into a ball (not shown) to form the collapsed configuration produces satisfactory results upon inflation of the bladder 24.

Referring to FIGS. 1 and 2, although the bladder 24 is shown attached to an existing pad 20 at the top of the helmet 12, the bladder may be attached directly to the shell 12 if the helmet lacks a pad at the top. It is also envisioned that the bladder 24 could be constructed and arranged so that the bladder functions as a pad 20 in the collapsed configuration or in a slightly expanded configuration.

It is also contemplated that the bladder 24 and helmet 12 be configured so that a portion of the bladder is adjacent the shell 14. The connector 38 may then extend through the shell 14 and be connected directly to the bladder to provide direct fluid communication with the chamber 30 thereby eliminating the tube.

In use, the bladder 24 is attached to the helmet 12 and the tube 28 is coiled within the helmet. After an accident or other mishap, the lower end 28*a* of the tube 28 is located using the indicia 36, and the lower end is pulled outward from the helmet 12 to straighten out the tube and make the lower end accessible. The canister 44 is connected to the connector 38, and through use of the valve 46, pressurized air is selectively supplied into the internal chamber 30 of the bladder 24. As air enters the bladder 24, the bladder unfolds from the collapsed configuration rupturing the connection between the tacking strips 48 and bladder 24.

During inflation, as the bladder 24 unfolds and the volume of the chamber 30 expands, the bladder exerts opposing forces on the helmet 12 and top 16*a* of the head 16. The forces move the helmet 12 away from the head 16. As the bladder 24 is being inflated, the movement of the helmet 12 relative to the head 16 may be guided by the user.

The bladder 24 is inflated until the head 16 is at least partially and preferably almost completely displaced from the helmet. The helmet 12 may then be completely removed from the head 16 by grasping the helmet and sliding the helmet from the head.

Figure 4:
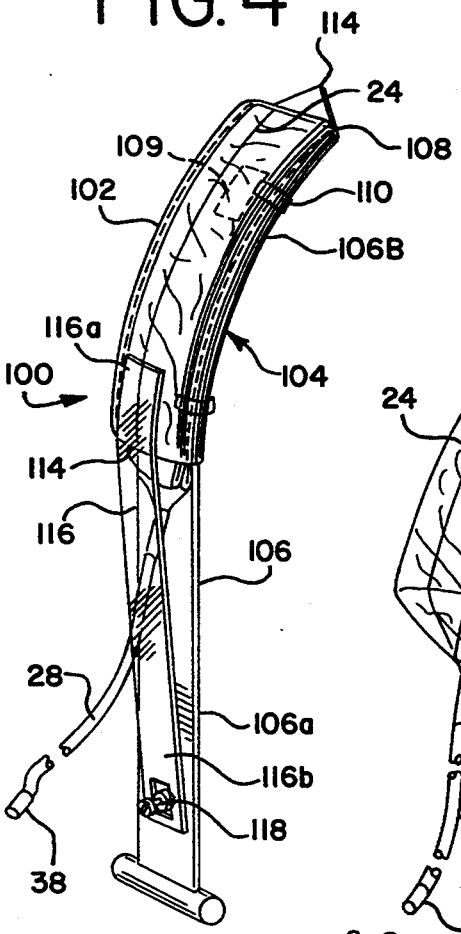
FIG. 4 is a perspective view of an alternate embodiment of the invention.
Figure 6:
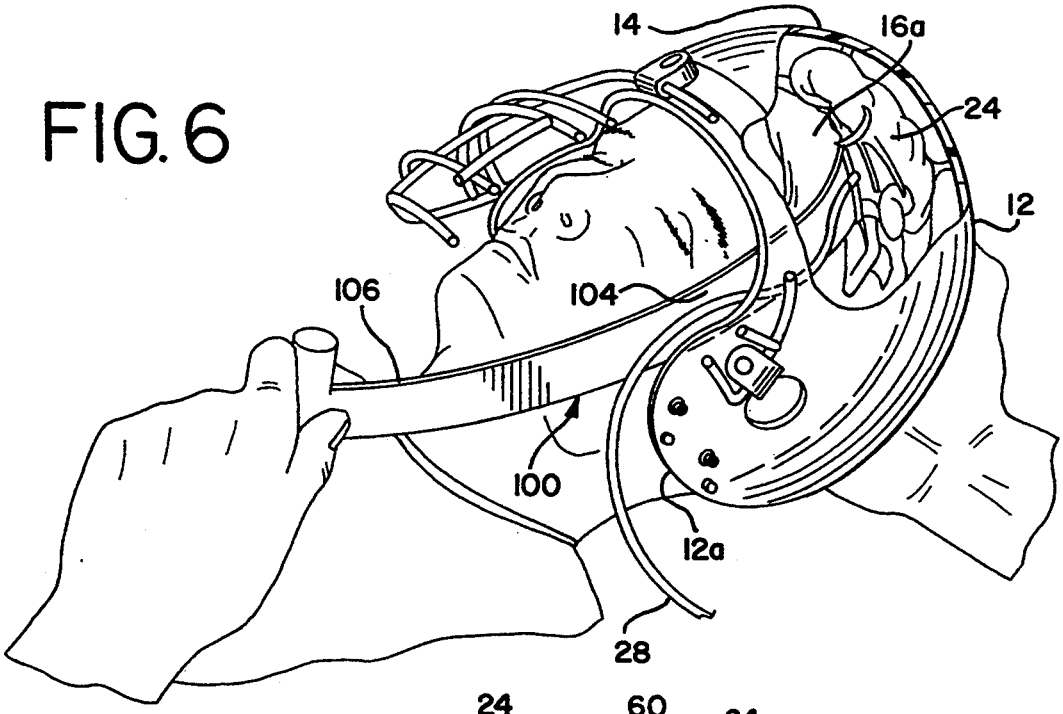
FIG. 6 is a perspective view with parts broken away of the device of FIG. 4 shown inserted between the head and helmet.

Referring to FIGS. 4, 5 and 6, an alternate embodiment of the helmet removal device of the present invention is generally indicated at 100. The device 100 is particularly suited for removing helmets 12 from the head 16 after an incident occurs which precludes pulling the helmet off, and the helmet does not have the helmet removal device 10, described above, previously installed.

The device 100 includes the bladder 24, tube 28 and connector 38 described above. However the bladder 24 is folded and disposed within a protective wrap 102 forming a part of an inserting tool 104. The inserting tool 104 also includes an elongated member or slat 106 which is preferably flexible and composed of metal or plastic. The slat 106 includes a rear straight portion 106*a* and a forward curved portion 106*b*. As illustrated in FIG. 6, the forward portion 106*a* is curved to fit about the top of the head 16 while the rear portion 106*b* extends along the side of the head.

Referring back to FIGS. 4 and 5 in conjunction with FIG. 8, the bladder 24 is folded to form the pleats 68. Then the bladder 24 is folded lengthwise to reduce the width of the folded bladder so that the bladder has a similar width as the slat 106. The bladder 24 may then be folded in half, as shown in FIG. 5 and placed on an outer surface 107 of the slat 106 in close proximity to a forward end 108.

The bladder 24 is arranged within the wrap 102 so that the connection between the bladder and tube 28 is disposed adjacent the slat 106 and away from a forward end 108 of the slat. Thus, when the bladder 24 is being inflated, the bladder unfolds away from the tube 28 and the connection between the tube and bladder generally remains in the same location which reduces the possibility of the tube being pinched. Both the bladder 24 and wrap 102 may be attached to the slat 106 by adhesive strips 109.

The wrap 102 maintains the bladder 24 in the folded configuration as the slat 106 is being inserted between the helmet 12 and head 16. The wrap 102 is preferably formed by a sheet of plastic or the like which is attached to the slat 106. The wrap 102 is then wrapped about the folded bladder 24 by placing a central portion 102 *a* of the wrap adjacent the slat 106 opposite the bladder. Edge flaps 102 *b* of the wrap 102 are then wrapped about the bladder 24. The wrap 102 is held about the bladder with tacking strips 110 similar to tacking strips 48 (FIG. 3). Alternately, the bladder 24 may be retained in a folded position by a rupturable sleeve or bag (not shown) extending about the bladder 24.

During insertion of the tool 104 between the helmet 12 and head 16, the tool may have to penetrate through the wearer's hair. To aid in this penetration, the forward end 108 is formed into a point 114 to part the hair. To reduce the probability that the tool 104 becomes entangled with the pads 20 of the helmet 12, the radius of curvature "R" of the forward portion 102 *b* is preferably less than the general radius of curvature r (FIG. 2) of the head 16. The radius of curvature R thereby maintains the forward end 108 adjacent the head 16 as the forward end travels about the head during insertion of the tool between the helmet 12 and head. A typical radius R is about 4 inches.

However, if during insertion the tool 104 becomes entangled, the tool may have to be pulled out and inserted along a different path. To prevent a rear edge 114 of the wrap 102 or the folded bladder 24 from catching on the helmet 12 during removal, the tool 104 may include a guard strap 116. A forward end **116*a* of the strap guard 116 is attached to the upper surface of the wrap 102 when the wrap is wrapped about the bladder 24. The rearward end 116*b* of the strap 116 is removably held by extending a retaining member 118 through an aperture 120 formed in the strap. The retaining member 118 may be the illustrated bolt, a hook punched from the slat 106 or the like. The strap 116** should be tautly held.

Measuring indicia 124 may be placed on the slat 106 so that the user can determine the proper length of insertion of the slat between the helmet 12 and head 16 so that the bladder 24 is placed generally at the top of the head. To facilitate handling, the tool 104 may also include a handle 126 attached to a lower end of the slat 106.

Referring to FIGS. 4 and 6, in use the device 100 is placed adjacent the helmet 16 with the forward portion **106*a* of the slat 106 extending about the upper curved portion of the helmet 12 and the bladder 24 adjacent the top 16*a* of the head 16. A point on the helmet 16 such as the lower edge 16*a* of the helmet and the measuring indicia 124 may be compared to determine the proper length of insertion of the slat 106**.

The forward end 108 of the inserting tool 104 is then inserted between the helmet 12 and head 16. The insertion point should be at a point where the pads 20 will not unduly interfere with the passage of the tool 104 between the helmet and head. The forward end 108 of the inserting tool 104 is then pushed toward the top of the head 16 until the indicia 124, which was previously marked, is adjacent the lower edge **12*a* of the helmet 12 thereby signifying the bladder 24 is disposed generally adjacent the top of the head 16. The lower end 116*b* of the strap guard 116 is released from the retaining member 118**.

A connection is made between the tube 28 and canister 44 (FIG. 1) by connecting the canister to the connector 38. The remaining steps are similar to the steps described above for the use of the preferred embodiment during inflation of the bladder 24.

Referring to FIG. 5, the alternate embodiment of the helmet removal device 100 may be supplied in the form of a kit 200 particularly suited for users which may need to remove a plurality of helmets 12. The kit 200 includes the bladder 24, tube 28 and connector 38 with the bladder, tube and connector assembled. The kit 200 also includes the inserting tool 104 with the wrap 102 and strap 116 attached or detached to the slat 106. To insure portability, the kit 200 should also include the canister 44 for inflating the bladder 24.

A specific embodiment of the novel helmet removal device according to the present invention has been described for the purposes of illustrating the manner in which the invention may be made and used. It should be understood, however, that implementation of other variations and modifications of the invention in its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

What is claimed is:

1. A device for removing a helmet from about the head of a wearer, the device comprising:

a bladder adapted to be disposed between the helmet and the head of the wearer, the bladder being folded into a collapsed configuration and expandable by inflation to cause the bladder to apply a force on the head and the inside of the helmet in a direction to at least partially displace the head from within the helmet to facilitate the removal of the helmet.

2. The device of claim 1 further including means for releasably retaining the bladder in the folded configuration prior to inflation.

3. A device for removing a helmet from about the head of a wearer, the device comprising:

a bladder adapted to be disposed between the helmet and the head of the wearer, and expandable by inflation to cause said bladder to apply a force on the head in a direction to at least partially displace the head from within the helmet to facilitate the removal of the helmet; and means for inserting the bladder between the head and helmet and placing the bladder in a desired location between the helmet and head.

4. The device of claim 3 wherein said inserting means includes an elongated member and means for releasably retaining the bladder at a forward end portion of the elongated member.

5. The device of claim 3 wherein the bladder is arranged in a folded configuration and a retaining means retains the bladder in the folded configuration during the insertion of the bladder between the helmet and head.

6. The device of claim 3 wherein the inserting means includes means for preventing the entanglement of a forward end of the inserting means in the hair of the wearer.

7. The device of claim 3 wherein said inserting means includes, a slat member having a straightened rear portion and a curved forward portion, and retaining means contacting at least one of the bladder and slat member for releasably retaining the bladder generally adjacent the curved portion of the slat member.

8. The device of claim 3 wherein the bladder defines a chamber, the device including means in fluid communication with the chamber for inflating the bladder.

9. The device of claim 8 wherein the inflating means includes a tube member in fluid communication with the chamber.

10. The device of claim 8 wherein the inflating means includes a means in fluid communication with the chamber for supplying a pressurized fluid to the chamber.

11. The device of claim 9 wherein the inflating means includes means removably connected to the tube member for providing pressurized fluid to the chamber to inflate the bladder.

12. A method for removing a helmet from about the head of a wearer comprising the steps of:

after the helmet is placed about the head, inserting a bladder within the helmet at a location generally corresponding to the top of the wearer's head; and inflating the bladder, said inflating step including partially displacing the head from within the helmet and facilitating the removal of the head from within the helmet.

13. The method of claim 12 further including folding the bladder into a collapsed configuration.

14. A kit for removing a helmet from about the head of a wearer, comprising:

means for at least partially displacing the head from within the helmet, the displacing means including a bladder defining an internal chamber, the chamber being expandable by inflation to cause said bladder to apply a force on the head in a direction to at least partially displace the head from within the helmet to facilitate the removal of the helmet, the displacing means including a tube member in fluid communication with said chamber;

means for inserting the bladder between the head and helmet and placing the bladder in a desired location between the helmet and head;

means for releasably retaining the bladder at one end of the inserting means when the bladder is disposed adjacent said one end; and means adapted to be selectively connected to the tube member for providing compressed gas to the chamber.

15. A combination helmet and helmet removal device comprising:

a helmet configured to generally fit about a head of a wearer; and a foldable bladder within the helmet at a location whereby the bladder is disposed between the helmet and the head when the helmet is worn about the head, the bladder being folded into a collapsed configuration, the bladder being expandable by inflation to cause said bladder to unfold and apply a force on the head to at least partially displace the head from within the helmet to facilitate the removal of the helmet.

16. The device of claim 15 further including means for releasably retaining the bladder in the folded configuration prior to inflation.

* * * * *